US008322181B2

(12) United States Patent
Wilson

(10) Patent No.: US 8,322,181 B2
(45) Date of Patent: Dec. 4, 2012

(54) ROTARY BENDING SYSTEM

(75) Inventor: David Michael Wilson, Huber Heights, OH (US)

(73) Assignee: Ready Technology, Inc., Dayton, OH (US)

( * ) Notice: Subject to any disclaimer, the term of this patent is extended or adjusted under 35 U.S.C. 154(b) by 299 days.

(21) Appl. No.: 12/769,720

(22) Filed: Apr. 29, 2010

(65) Prior Publication Data

US 2011/0265546 A1 Nov. 3, 2011

(51) Int. Cl.
*B21D 5/04* (2006.01)

(52) U.S. Cl. ..... 72/319; 72/387

(58) Field of Classification Search ..... 72/387, 72/388, 319–321, 310, 312–313, 298
See application file for complete search history.

(56) References Cited

U.S. PATENT DOCUMENTS 4,002,049 A 1/1977 Randolph, Sr.
4,181,002 A * 1/1980 Eckold et al. ..... 72/387
4,434,644 A 3/1984 Gargrave et al.
5,341,669 A * 8/1994 Katz ..... 72/387
5,361,620 A 11/1994 Meadows
5,404,742 A 4/1995 Wilson et al.
6,021,659 A * 2/2000 Russell ..... 72/481.7
6,065,324 A * 5/2000 Russell ..... 72/387
6,983,634 B2 1/2006 Chun et al.

OTHER PUBLICATIONS

Ready Technology, Inc., Ready Benders: A Unique Off-the-Shelf Forming Tool, 2006, pp. 1-20, Catalog No. 0606, Ready Technology, Inc., United States.

* cited by examiner

*Primary Examiner* — Faye Francis
(74) *Attorney, Agent, or Firm* — Maginot, Moore & Beck

(57) ABSTRACT

A forming assembly includes, a rocker having an operating surface defining a cavity, the operating surface including a first cavity surface and a second cavity surface, a saddle defining a space in which the rocker rotates, and a pad extending into the cavity and defining (i) an abutment surface which faces toward the saddle and defines a first plane, and (ii) a workpiece contact surface which faces away from the saddle and defines a second plane, wherein relative movement between the saddle and the pad when the first cavity surface is positioned in contact with the abutment surface causes rotation of the rocker within the space, wherein rotation of the rocker within the space causes the second cavity surface to advance toward the workpiece contact surface, and wherein the first plane intersects the second plane so as to define an angle θ.

12 Claims, 8 Drawing Sheets

ROTARY BENDING SYSTEM

FIELD OF THE INVENTION

The present disclosure generally relates to sheet forming tools. More specifically, the present disclosure relates to bending systems.

BACKGROUND OF RELATED ART

Manufacturers commonly bend, shape, and cut workpieces with machine presses, press brakes, and punch presses. These, and other force engines, are collectively referred to herein as "presses". As shown in FIG. 1, a press 10 typically includes a hydraulically driven ram 14 configured to move relative to a bed 18. The ram 14 usually moves along a vertical or horizontal axis toward and away from the bed 18. Conventionally, presses 10 shape workpieces with a set of tools and/or dies that may be coupled to the ram 14 and the bed 18. The press 10 of FIG. 1 includes a tool 22 coupled to the ram 14 and a tool 26 coupled to the bed 18. Exemplary workpieces that may be cut, bent, or otherwise formed include sheet metal and other industrial materials.

The press 10, having the vertically displaceable ram, bends a workpiece according to the following exemplary forming process. First, the ram 14 is lifted to an elevated position. Next, the workpiece is placed on the tool 26. After the workpiece is properly positioned, the ram 14 is released from the elevated position. Releasing the ram 14 initiates a downstroke of the press 10 so that the ram 14 and the tool 22 move toward the bed 18 and the tool 26. As the ram 14 moves toward the bed 18, the tool 22 presses the workpiece against the tool 26 to bend, shape, or form the workpiece. At the completion of the downstroke, the ram 14 is lifted again to the elevated position. The formed workpiece may then be removed from the press 10 by either a user or a machine. Some high speed presses may repeat the forming process at a rate of approximately two hundred cycles per minute.

A rotary bending device is a tool that may be coupled to the ram 14 of the press 10. Rotary bending devices are useful for bending a portion of a workpiece, referred to as a skirt, relative to a remainder of the workpiece. The skirt is a strip of material that stiffens the workpiece when bent relative to the remainder of the workpiece. Forming a skirt on the workpiece may be the first of a number of steps involved in hemming the workpiece.

Rotary bending devices include a saddle and a rocker. The saddle is connected to the ram 14, and the rocker is rotatably supported within the saddle. During a downstroke of the press 10, the rocker is forced into contact with the workpiece to bend the skirt. In particular, as the rotary bending device approaches the workpiece, the rocker contacts the workpiece and begins to rotate. Continued movement of the ram 14 toward the workpiece causes the rotation of the rocker to bend the skirt to a predetermined angle with respect to the remainder of the workpiece. The magnitude of the predetermined angle depends on the characteristics of the rocker.

Depending on the end use of the workpiece, it may be desirable to bend the skirt very close to the remainder of the workpiece with a single stroke of the press 10. Known rotary bending devices, however, have a limited minimum predetermined angle. Specifically, many known rotary benders, bend the skirt to within ninety degrees) (90°) of the remainder of the workpiece without difficulty, because the rocker is easily lifted from the formed workpiece on the upstroke of the ram 14 for predetermined angles ranging from one hundred eighty degrees) (180° to ninety degrees) (90°). If, however, the predetermined angle is less than ninety degrees) (90°), overlap between the rocker and the workpiece may cause the rocker to drag against the skirt on the upstroke of the ram 14. The dragging rocker may undesirably deform or mar the skirt. The potential for deforming the skirt increases in response to an increased amount of overlap between the rocker and the workpiece. Stated differently, the potential for deforming the skirt increases in response to a decreased angle between the skirt and the remainder of the workpiece. Therefore, a rotary bending device capable of bending a skirt on a workpiece without deforming the workpiece is desirable.

SUMMARY

According to one embodiment of the present disclosure, a forming assembly includes, a rocker having an operating surface defining a cavity, the operating surface including a first cavity surface and a second cavity surface, a saddle defining a space in which the rocker rotates, and a pad extending into the cavity and defining (i) an abutment surface which faces toward the saddle and defines a first plane, and (ii) a workpiece contact surface which faces away from the saddle and defines a second plane, wherein relative movement between the saddle and the pad when the first cavity surface is positioned in contact with the abutment surface causes rotation of the rocker within the space, wherein rotation of the rocker within the space causes the second cavity surface to advance toward the workpiece contact surface, and wherein the first plane intersects the second plane so as to define an angle θ.

According to another embodiment of the present disclosure a forming method includes, (a) positioning a workpiece contact surface of a pad against a workpiece, (b) moving a saddle in relation to the pad, (c) advancing a first cavity surface of a rocker into contact with the pad so as to cause rotation of a rocker in response to the step (b), wherein the rocker includes a cavity defined by the first cavity surface, a second cavity surface, and a curved transition surface interposed therebetween, (d) advancing the second cavity surface into contact with the workpiece so as to bend the workpiece in response to rotation of the rocker, and (e) advancing the second cavity surface into contact with the pad.

BRIEF DESCRIPTION OF THE FIGURES

Features of the present invention will become apparent to those skilled in the art from the following description with reference to the drawings, in which.

DETAILED DESCRIPTION

For the purpose of promoting an understanding of the principles of the system described herein, reference is made to the embodiments illustrated in the figures and described in detail herein. It should be understood that no limitation to the scope of the system is thereby intended. It should be further understood that the system includes any alterations and modifications to the illustrated embodiments and includes further applications of the principles of the system as would normally occur to one skilled in the art to which the system pertains.

Figure 4:
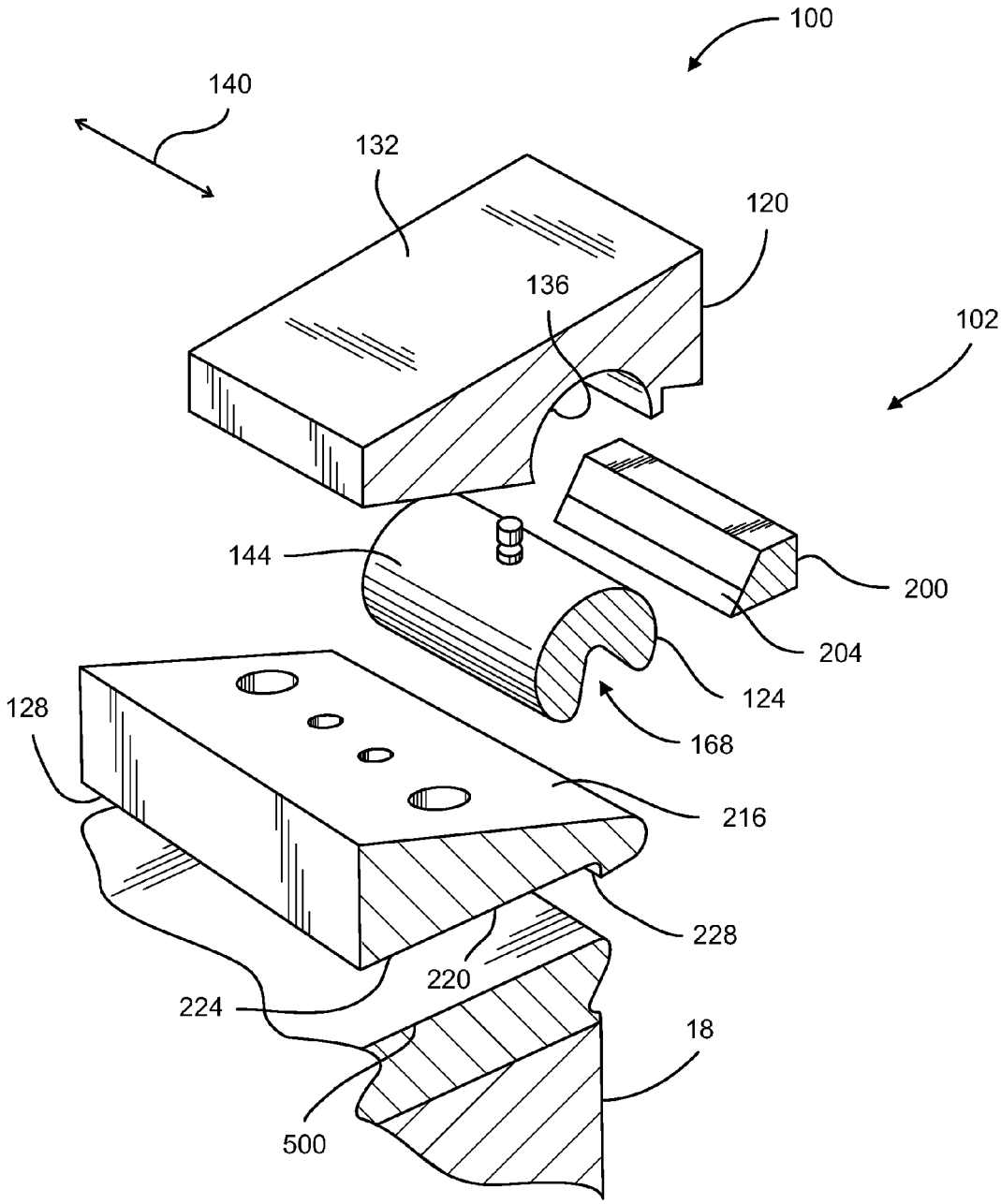
FIG. 4 depicts an exploded perspective view of the bending system of FIG. 3.

A rotary bending system 100 is described herein, as shown in FIG. 4. The system 100 includes a forming assembly, referred to herein as a bending apparatus 102. The apparatus 102 may be coupled to a machine press such as the exemplary press 10 illustrated in prior art FIG. 1. The press 10 includes a ram 14 that moves toward a bed 18 during a downstroke and that moves away from the bed 18 during an upstroke. The ram 14 moves relative the bed 18 along a linear path. A saddle portion 120 of the apparatus 102 is coupled to the ram 14 to bend a workpiece 104 (see e.g. FIG. 5) during a downstroke of the press 10.

Figure 2A:
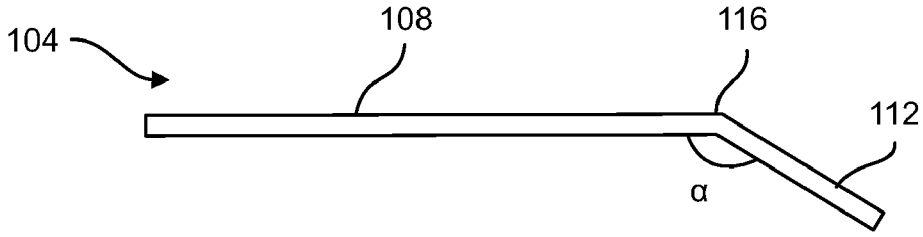
FIGS. 2A-2C depict side elevational views of a workpiece having a skirt that has been bent with respect to a remainder of the workpiece.
Figure 2B:
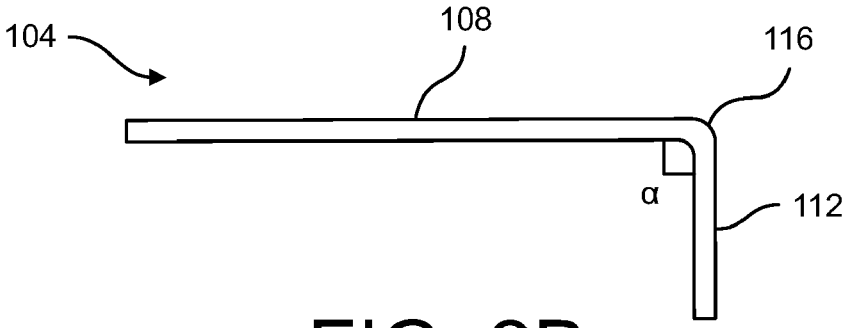
Figure 2C:
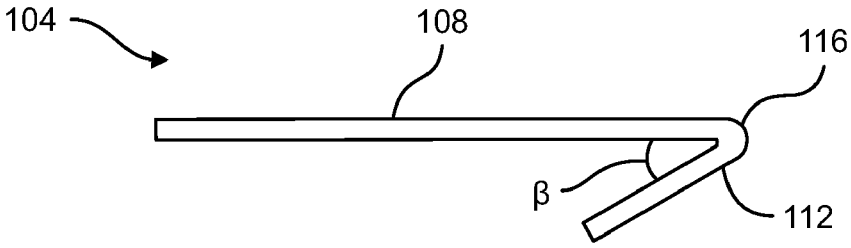

A side elevational view of an exemplary workpiece 104 that may be bent with the apparatus 102 is shown in FIGS. 2A and 2B. The workpiece 104 includes a remainder 108 and a skirt 112. The skirt 112 is contiguous with the remainder 108, and a bend area 116 defines the boundary between the skirt 112 and the remainder 108. Before the workpiece 104 is bent by the apparatus 102, the skirt 112 is pre-bent relative to the remainder 108 to the angle $\alpha$ by conventional forming equipment that are well known to one of ordinary skill in the art. The angle $\alpha$ has a magnitude between approximately one hundred fifty degrees) (150°) (FIG. 2A) and ninety degrees) (90°) (FIG. 2B). The apparatus 102 is operable to bend the pre-bent skirt 112 from the angle $\alpha$ to an angle $\beta$ with a single stroke of the press 10. The angle $\beta$ possesses a magnitude less than ninety degrees) (90°), and preferably less than forty five degrees) (45°), and most preferably approximately fifteen degrees) (15°) (FIG. 2C). After the skirt 112 is bent to the angle $\beta$, the apparatus 102 may be lifted from the workpiece 104 without deforming, marring, or otherwise affecting the shape of the workpiece 104. Below, the system 100 and a method for operating the system 100 are explained in detail.

Figure 3:
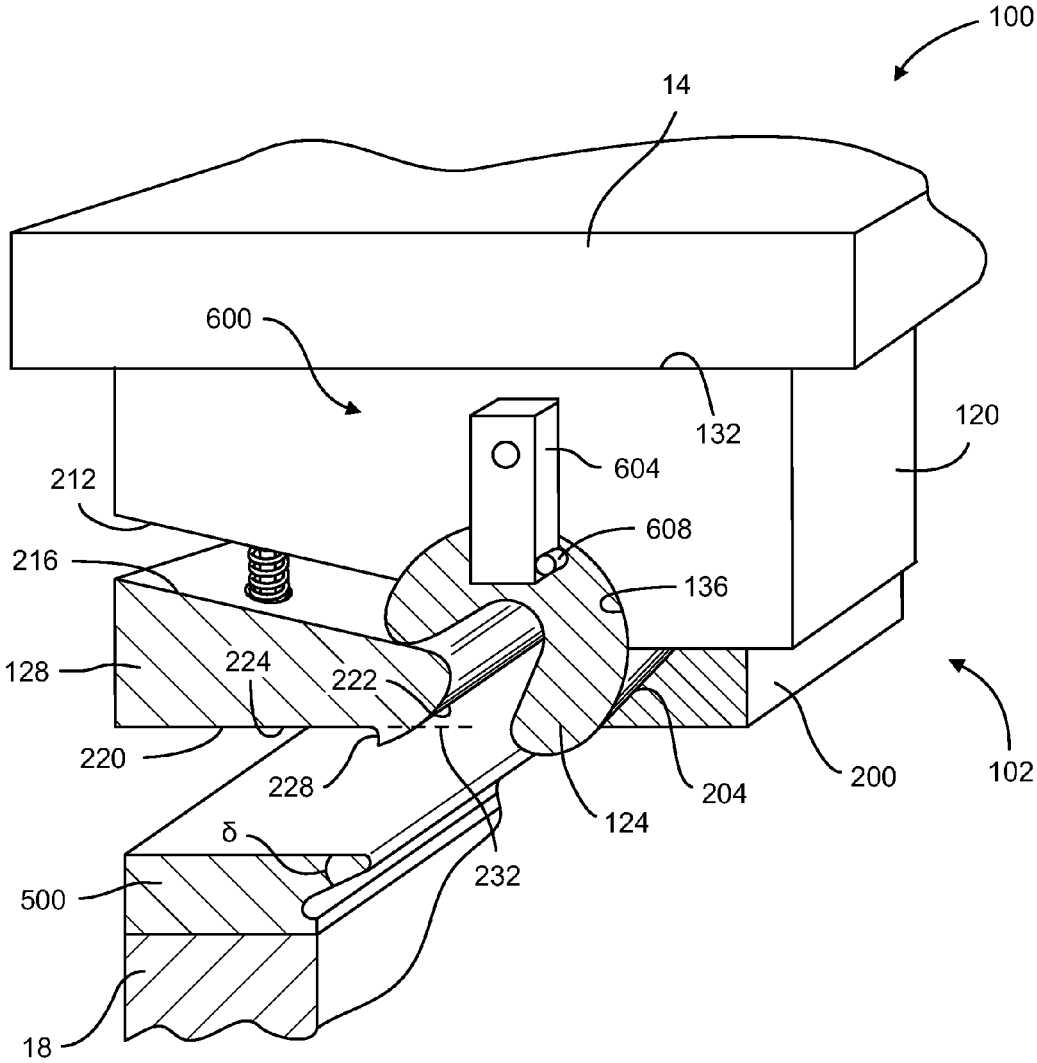
FIG. 3 depicts a perspective view of a bending system, according to the present disclosure, which is coupled to the ram of the machine press of FIG. 1.

As shown in FIG. 3, the apparatus 102 includes a saddle 120, a rocker 124, and a pad 128. The saddle 120 is shown connected to the ram 14 of the press 10. The rocker 124 is rotatably mounted within the saddle 120. The pad 128 is movably mounted to the saddle 120. In response to the ram 14 moving toward the bed 18, the pad 128 contacts the workpiece 104 (not shown in FIG. 3, but see FIGS. 4-5) that is positioned on or above the bed 18. After the pad 128 contacts the workpiece 104 and stops moving relative to the workpiece 104, the saddle 120 continues to move relative to the workpiece 104, thereby causing the rocker 124 to rotate within the saddle 120. The rotation of the rocker 124 bends the skirt 112 of the workpiece 104 from the angle $\alpha$ to the angle $\beta$. In response to an upstroke of the press 10, the pad 128 separates the rocker 124 from the workpiece 104 to prevent the rocker 124 from affecting the shape of the workpiece 104 as the apparatus 102 is lifted from the bed 18.

The saddle 120 is formed from, among other materials, machinable through hardened steel. A computer numerical controlled ("CNC") milling machine, among other metal forming machines, may be used to form the saddle 120. An upper surface 132, also shown in FIG. 4, of the saddle 120 is milled to match the contour of the ram 14. As shown in FIGS. 3 and 4, the saddle 120 defines a space 136 in which the rocker 124 rotates. The space 136, which may also be referred to as a socket, is a generally arcuate surface that matches the exterior surface of rocker 124. A radius of the space 136 is approximately the same as a radius of the rocker 124. The rocker 124 maintains contact with the space 136 as the rocker 124 rotates relative to the saddle 120. A length of the space 136, as measured in direction 140 (FIG. 4), is at least as long as a length of the rocker 124. The junction of the space 136 and the rocker 124 is lubricated to ensure that the rocker 124 rotates easily within the space 136. The saddle 120 may include fittings (not illustrated) for supplying the junction between the rocker 124 and the space 136 with lubrication, such as oil as may be specified by a manufacturer of the system 100.

The rocker 124 rotates within the saddle 120 to convert the linear motion of the ram 14 to a rotational motion for bending the skirt 112. The rocker 124 is formed from, among other materials, cylindrical metal stock. In particular, the rocker 124 is formed from fully hardened tool steel having a hardness of fifty-six to sixty-two Rc as measured on the Rockwell hardness scale. The rocker 124 may have a length, as measured in direction 140, of up to ninety centimeters (90 cm). Two or more apparatus 102 may be placed adjacent to one another to increase the total effective length of the rocker 124, and to enable the apparatus 100 to bend a workpiece 104 longer than ninety centimeters (90 cm) in a single stroke of the press 10.

Figure 5:
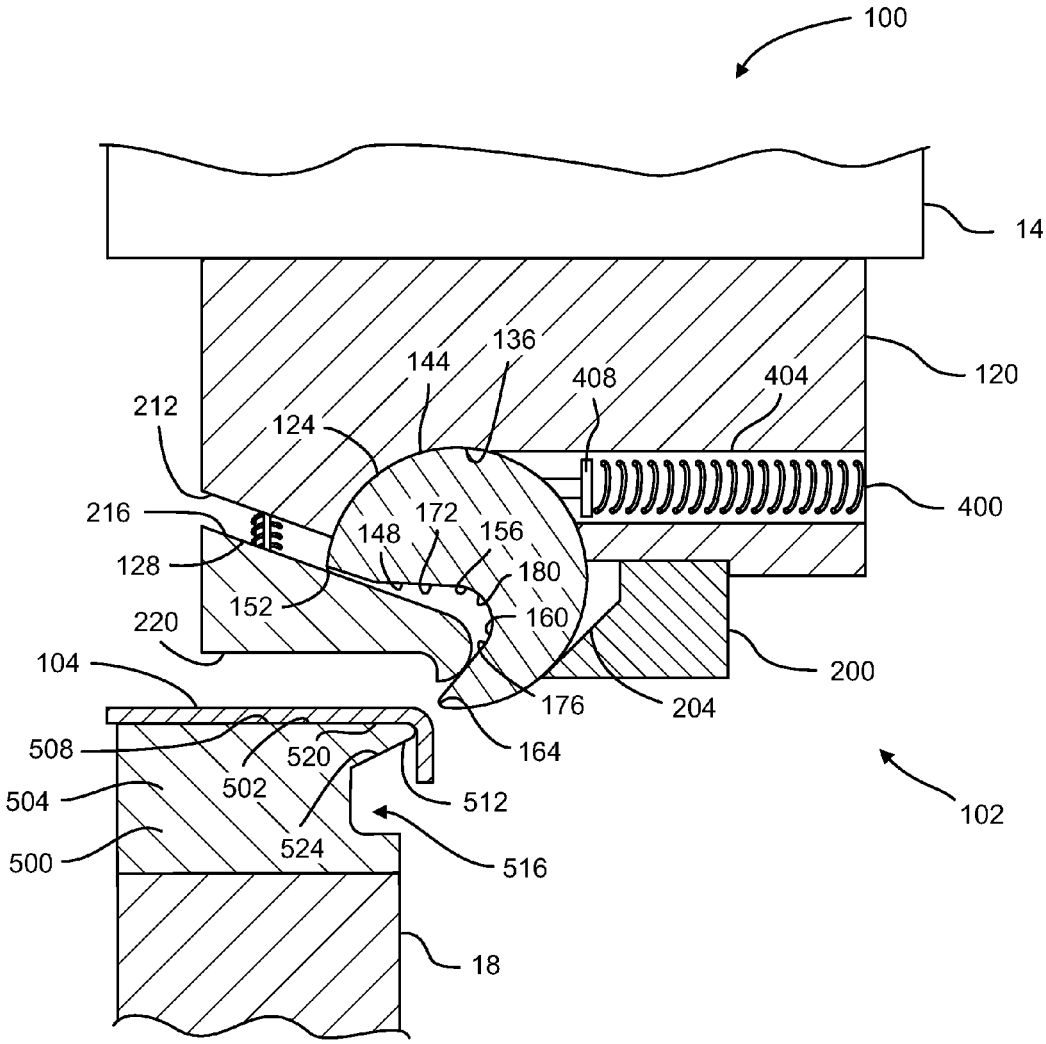
FIG. 5 depicts a cross sectional view of the bending system of FIG. 3, with a pad of the bending apparatus in an extended position.

As shown in FIG. 5, the rocker 124 includes an exterior surface 144 and an operating surface 148. The exterior surface 144 extends clockwise from a point 152 to a point 164. The exterior surface 144 contacts the surface which defines the space 136 as the rocker 124 rotates relative to the saddle 120. The operating surface 148 extends from the point 152 to the point 164 and passes through a point 156 and a point 160. The generally "C" shaped operating surface 148 defines a cavity 168 (FIG. 4). In particular, and as shown in FIG. 5, the operating surface 148 includes a cavity surface 172, a cavity surface 176, and a transition surface 180. The cavity surface 172 extends along the operating surface 148 from the point 152 to the point 156, and the cavity surface 176 further extends along the operating surface 148 from the point 160 to the point 164. The transition surface 180 extends along the operating surface 148 from the point 156 to the point 160. The rocker 124 rotates within the space 136 from a first position in which the cavity surface 176 is spaced apart from the workpiece 104 to a second position in which the cavity surface 176 contacts the workpiece 104 and the pad 128. The angle $\gamma$ (FIG. 6) between the cavity surface 172 and the cavity surface 176 determines, in part, the angle $\beta$, as described below.

Figure 6:
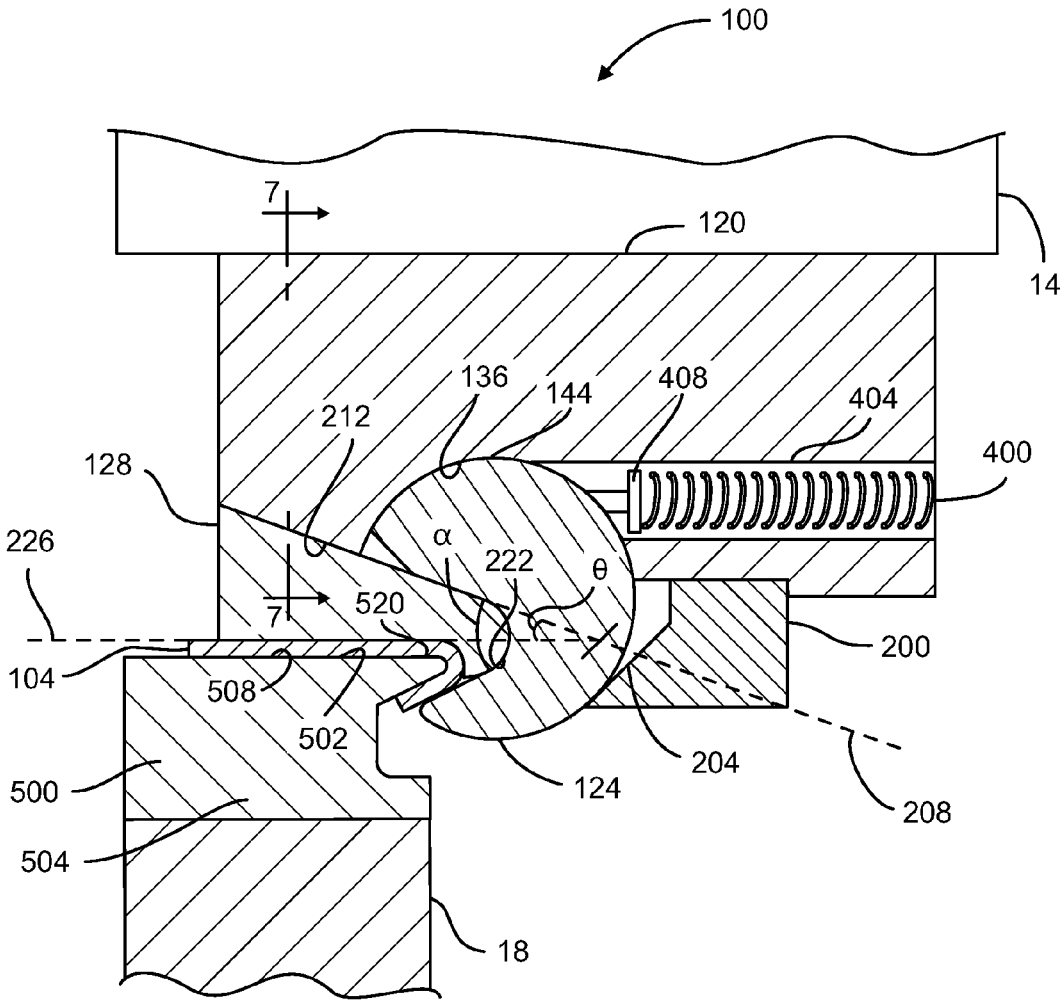
FIG. 6 is a view similar to FIG. 5, but showing the bending system of FIG. 3 with the pad of the apparatus in a seated position.

The apparatus 102 includes a gib 200 coupled to the saddle 120 for retaining the rocker 124 in the space 136, as shown in FIGS. 3-5. The gib 200 may be formed from the same material as the saddle 120; namely, machinable through hardened steel. As shown in FIG. 6, the gib 200 is positioned on the side of the saddle 120 opposite the pad 128, such that the rocker 124 is interposed between the saddle 120 and the gib 200. The gib 200 moves in unison with the saddle 120. As illustrated, the gib 200 has a length, measured in direction 140 (FIG. 4) approximately equal to the length the rocker 124. Alternatively, however, the gib 200 may include multiple sections that are positioned along the length of the rocker 124. The gib 200 includes a retention portion 204 that contacts the rocker 124 as the rocker rotates within the space 136. As shown in FIG. 6, the retention portion 204 contacts the rocker 124 below a plane 208 defined by a surface 212 of the saddle 120 to prevent the rocker 124 from becoming separated from the saddle 120 as the rocker 124 rotates relative to the saddle 120.

As shown in FIGS. 3-6, the pad 128 is movably coupled to the saddle 120 and extends into the cavity 168. The rocker 124 rotates in response to the pad 128 moving relative to the saddle 120. The pad 128 moves between an extended position, as shown in FIGS. 3 and 5, to a seated position, as shown in FIG. 6. In particular, the pad 128 is in the seated position at the completion of the downstroke of the press 10, and the pad 128 is in the extended position when the pad 128 is not in contact with a workpiece 104. The pad 128 may be formed from the same material as the saddle 120; namely, machinable through hardened steel.

As shown in FIG. 3, the pad 128 includes an abutment surface 216 and a workpiece seat 220. The abutment surface 216 is on the top side of the pad 128 and faces toward the saddle 120. The abutment surface 216 is a generally planar surface that is approximately parallel to the surface 212 of the saddle 120. The workpiece seat 220 is on the bottom side of the pad 128 and faces away from the saddle 120. As shown in FIG. 6, the abutment surface 216 defines the plane 208 and at least a portion of the workpiece seat 220 defines a plane 226. The plane 208 intersects the plane 226 so as to define angle θ. At the completion of the downstroke, the abutment surface 216 contacts the surface 212. Relative movement between the saddle 120 and the pad 128 when the cavity surface 172 is positioned in contact with the abutment surface 216 causes rotation of the rocker 124 within the space 136.

The angle θ between abutment surface 216 and the workpiece seat 220 determines, in part, the angle β. In particular, the angle β deceases in response to a decrease in the angle θ, and the angle β increases in response to an increase in the angle θ. Accordingly, in response to a desired β of a workpiece 104, a pad 128 is made having the abutment surface 216 separated from the workpiece seat 220 by an angle θ, and a rocker 124 is made having the cavity surface 172 separated from the cavity surface 176 by at least the angle θ. The rocker 124 and the pad 128 are then coupled to the saddle 120 to form an apparatus 102 configured to bend the skirt 112 to the angle β from the remainder 108. The system 100 includes a plurality of pads 128 and rockers 124 that may be coupled to the saddle 120 in response to the particular angle β of the workpiece 104 to be formed.

Figure 8:
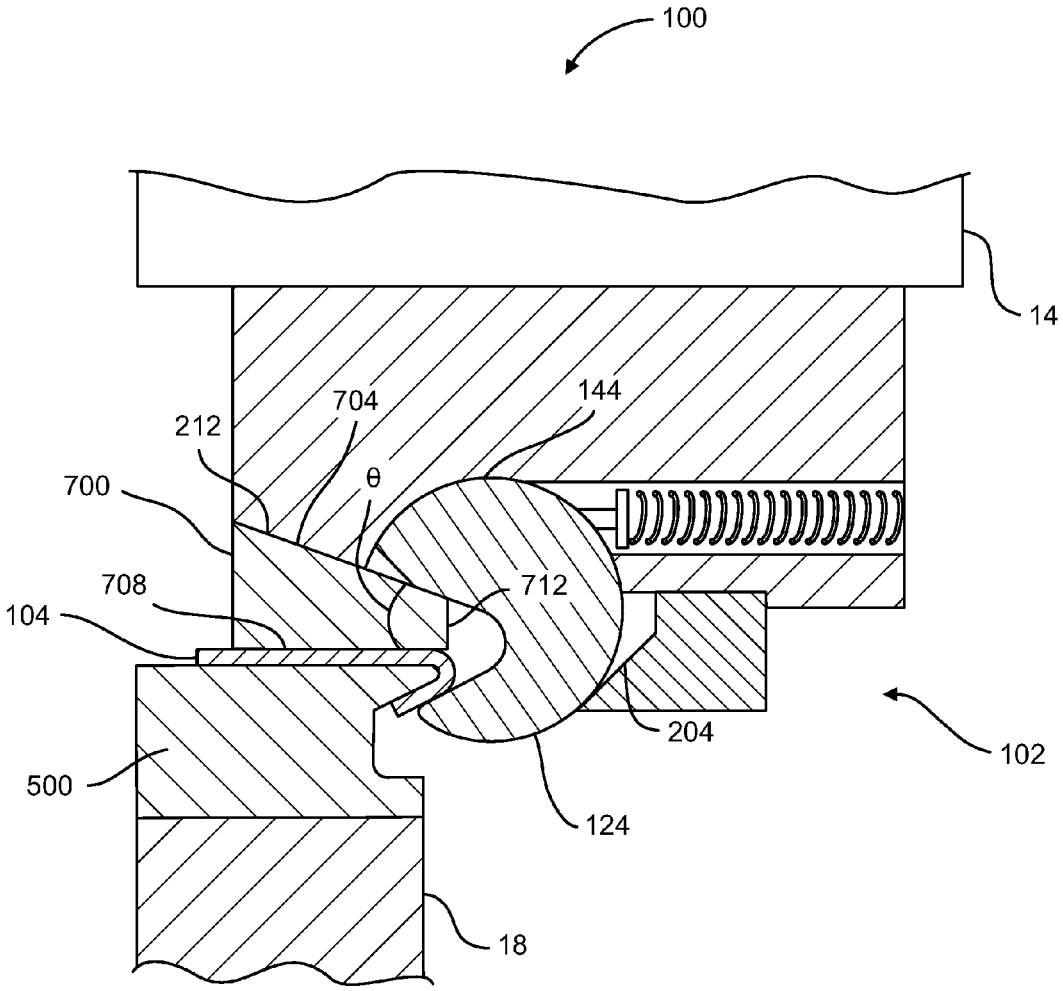
FIG. 8 depicts a view similar to the view of FIG. 6, but showing the bending system utilizing an alternative embodiment of a pad.

As shown in FIG. 3, the workpiece seat 220 defines a rocker seat 222, a workpiece contact surface 224, and a lip 228. The workpiece contact surface 224 is a generally flat portion of the workpiece seat 220 that is approximately parallel to the top surface of the bed 18. When the pad 128 is in the seated position, the workpiece contact surface 224 contacts the workpiece 104. Rotation of the rocker 124 within the space 136 causes the cavity surface 176 to advance toward the workpiece contact surface 224, such that a portion of the workpiece contact surface 224 is located inside of the cavity 168 when pad 128 is in the seated position. At least a portion of the workpiece contact surface 224 remains located outside of the cavity 168 when the pad 128 is in the seated position. The lip 228 extends below the workpiece contact surface 224, and, in response to the pad 128 being in the seated position, the lip 228 extends below the anvil 500. Alternatively, in another embodiment, the lip 228 may be omitted from the workpiece seat 220. In the embodiments in which, the pad 128 does not include a lip 228, the workpiece contact surface 224 extends along dashed line 232. An embodiment of the pad 128 in which the lip 228 is omitted is shown in FIG. 8.

The rocker seat 222 is on an edge of the pad 128 positioned between the abutment surface 216 and the workpiece contact surface 224. The rocker seat 222 is a curved portion of the workpiece seat 220 that is contiguous with the workpiece contact surface 224. The rocker seat 222 has a contour that matches approximately or exactly a contour of the cavity surface 176. As shown in FIG. 6, the rocker seat 222 is separated from the abutment surface 216 the angle γ, such that at the completion of the downstroke of the press 10, the cavity surface 176 (FIG. 5) contacts the rocker seat 222. Additionally, as the saddle 120 is lifted from the bed 18 during the upstroke, the cavity surface 176 contacts the rocker seat 222 to prevent the rocker 124 from marring or otherwise affecting the appearance of the skirt 112, as explained below.

Figure 7:
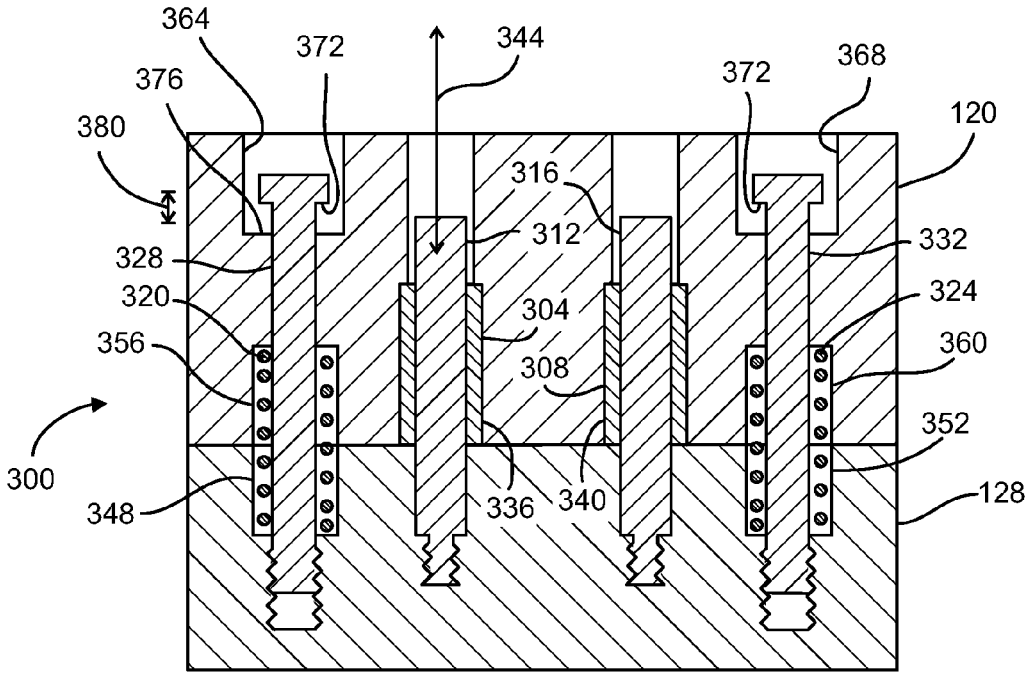
FIG. 7 depicts a cross sectional view of the bending system taken along line 7-7 of FIG. 6, with the pad of the apparatus in a seated position.

The pad 128 is coupled to the saddle 120 with a connection apparatus 300, as shown in FIG. 7. The connection apparatus 300 includes bushings 304, 308, guide pins 312, 316, springs 320, 324, and shoulder screws 328, 332. The bushings 304, 308 are pressed into cavities 336, 340 formed in the saddle 120 and do not move relative to the saddle 120. The guide pins 312, 316 are threadingly engaged to the pad 128 and extend through an opening in the bushings 304, 308. As the pad 128 moves between the seated and the extended positions, the guide pins 312, 316 slide within the bushings 304, 308. The guide pins 312, 316 ensure that the pad 128 moves approximately parallel to a longitudinal axis 344 of the guide pins 312, 316.

The springs 320, 324 of the connection apparatus 300 are compression springs having a spring constant as is well known to one of ordinary skill in the art. Each spring 320, 324 extends into a cavity 348, 352 formed in the pad 128 and a cavity 356, 360 formed in the saddle 120. The springs 320, 324 are shown in a compressed state in FIG. 7. The shoulder screws 328, 332 are inserted into openings 364, 368 in the top of the saddle 120 and are threaded into the pad 128. In response to the ram 14 being lifted from the bed 18, the springs 320, 324 urge the pad 128 away from the saddle 120 until a shoulder 372 of the shoulder screws 328, 332 contacts a floor 376 of the openings 364, 368. As shown in FIG. 7, when the pad 128 is in the seated position, the distance from the shoulder 372 to the floor 376 is approximately equal to the distance the pad 128 extends from the saddle 120 when the pad 128 is in the extended position. A distance 380 is referred to as the travel of the pad 128, and represents the separation between the pad 128 and the saddle 120 when the pad 128 is in the extended position. The distance 380 is determined, at least in part, by the depth of the openings 364, 368, which may be referred to as counterbores.

As shown in FIGS. 5 and 6, the apparatus 102 includes a return spring 400 coupled to the rocker 124 and to the saddle 120. The spring 400 is a compression spring positioned within a channel 404 in the saddle 120. The spring 400 is coupled to a post 408 formed on the rocker 124. The spring 400 has a spring constant as is well known to one of ordinary skill in the art. The spring 400 urges the rocker 124 in a rotating path as the pad 128 moves away from the saddle 120. In particular, the spring 400 biases the operating surface 148 against the abutment surface 216. As a result of the pad 128 being moved to the seated position, the rocker 124 rotates in the clockwise direction and the spring 400 is compressed, as shown in FIG. 6. The compressed spring 400 develops a biasing force that urges the rocker 124 in a counterclockwise direction (FIGS. 5 and 6) as the pad 128 moves to the extended position during the upstroke of the press 10.

As shown in FIGS. 3-6, the system 100 includes an anvil 500 coupled to the bed 18 of the press 10. The anvil 500, is formed from, machinable through hardened steel, similar to, or the same as, the saddle 120. As shown in FIG. 6, in response to the apparatus 102 being seated upon a workpiece 104, the anvil 500 is spaced apart from the workpiece contact surface 224 to define a workpiece space 502 therebetween. The workpiece space 502 is approximately equal to the thickness of the workpiece 104. Rotation of the rocker 124 within the space 136 causes the rocker 124 to move from a position in which a portion of the workpiece space 502 is located outside of the cavity 168 (FIG. 4) to a position in which the portion of the workpiece space 502 is located inside of the cavity 168 (FIG. 6).

The anvil 500 includes a body 504, a table top 508, a beak 512, and a cavity 516, as shown in FIG. 5. The body 504 is fixedly connected to the bed 18. The table top 508 is a generally planar surface that is positioned parallel to the workpiece contact surface 224 of the pad 128. The beak 512 is a protuberance that extends away from the body 504. An upper surface 520 of the beak 512 is continuous with the table top 508. A lower surface 524 of the beak 512 is separated from the upper surface 520 by an angle δ (FIG. 3). The lower surface 524 of the beak 512 defines an upper boundary of the cavity 516. The cavity 516 enables rocker 124 to bend the skirt 112 under table top 508 in response to the desired angle β being less than ninety degrees) (90°). To bend the skirt 112 relative to the remainder 108 to a predetermined angle β, the angle δ should be less than the angle β because the skirt 112 rebounds or "springs-back" slightly after the forming the process, as is known in the art.

As shown in FIG. 3, the system 100 includes a rotation limiting apparatus 600 coupled to the apparatus 102. The rotation limiting apparatus 600 prevents the rocker 124 from rotating in a counterclockwise direction (FIG. 3) in response to the rocker 124 contacting a workpiece 104. The apparatus 600 includes a block 604 and a post 608. The block 604 is fixedly coupled to the saddle 120 with a fastening member. The post 608 is fixedly coupled to the saddle 120. The spring 400 urges the post 608 against the block 604. The post 608 contacts the block 604 to prevent the rocker 124 from rotating in the counterclockwise direction (FIG. 3). The block 604 may be referred to as a kicker block. The system 100 may bend some workpieces 104 without the rotation limiting apparatus 600.

Figure 1:
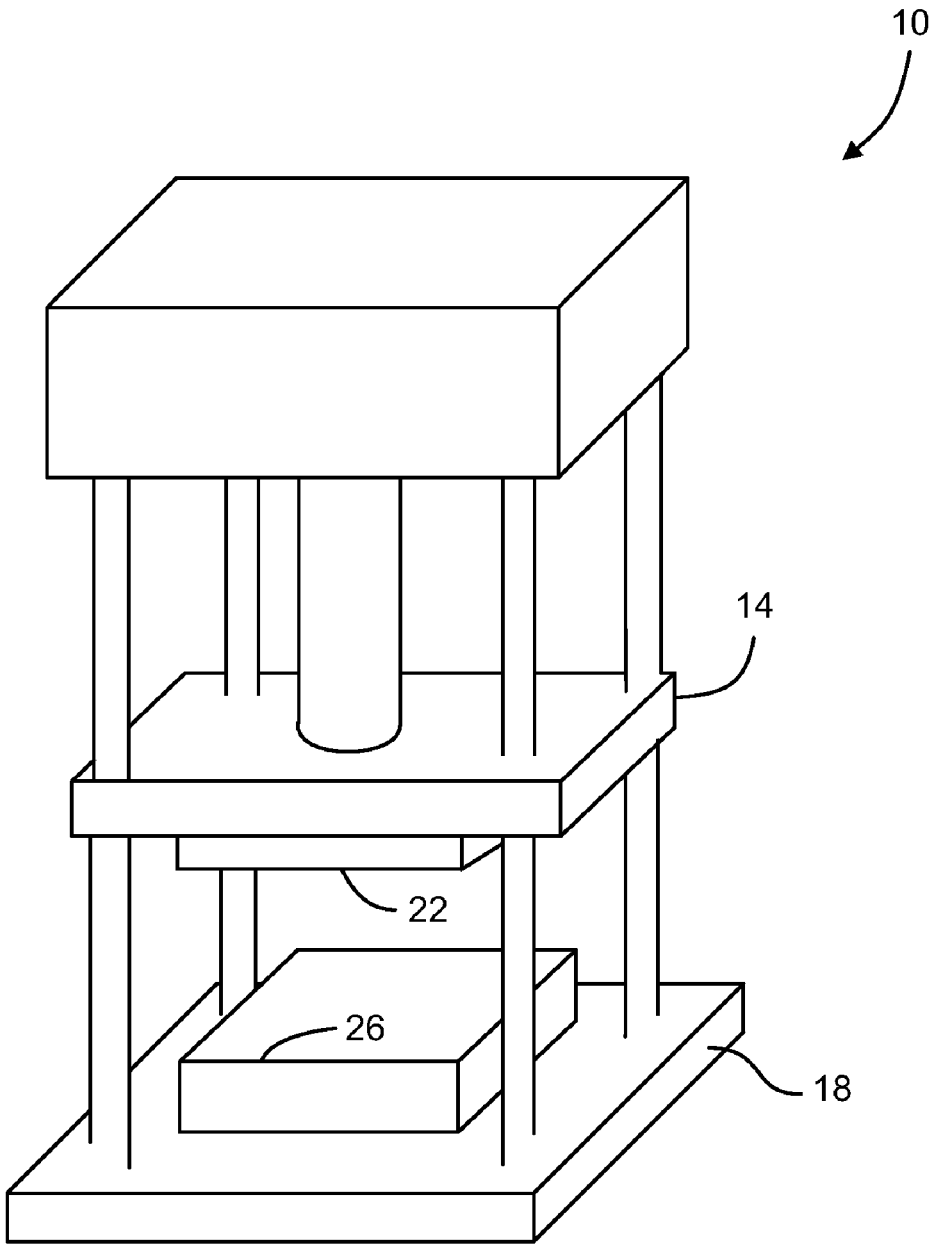
FIG. 1 PRIOR ART
FIG. 1 depicts a perspective view of a prior art machine press upon which a bending system may be coupled, the machine press including a ram that moves relative to a bed.

The system 100 operates in combination with a machine press, such as the exemplary press 10 of FIG. 1. First, an upstroke of the press 10 is initiated to elevate the ram 14 above the bed 18. Next, the saddle 120 is connected to the ram 14, and the anvil 500 is connected to the bed 18. If the saddle 120 includes a pad 128 having a lip 228, the saddle 120 is positioned on the ram 14, such that when the pad 128 is in the seated position, as shown in FIG. 6, the lip 228 is separated from the beak 512 by a thickness of the workpiece 104.

Once the saddle 120 is connected to the ram 14 and the anvil 500 is connected to the bed 18, a workpiece 104 is positioned on the anvil 500. The workpiece 104 is a "pre-bent" workpiece in which the angle α has a magnitude between approximately thirty degrees) (30°) (FIG. 2A) and ninety degrees) (90°) (FIG. 2B). The bend area 116 of the workpiece 104 is positioned against the beak 512 of the anvil 500. The workpiece 104 is not pre-bent with the apparatus 102; instead, a second apparatus is used to pre-bend the workpiece 104, as described above.

A downstroke of the press 10 is initiated after the workpiece 104 has been positioned on the anvil 500. During the downstroke, the saddle 120, the rocker 124, and the pad 128 move toward the workpiece. As the saddle 120 approaches the anvil 500, the workpiece contact surface 224 contacts the workpiece 104 to stabilize the remainder 108 against the anvil 500. The pad 128 stops moving relative the anvil 500 once the workpiece seat 220 contacts the workpiece 104. The saddle 120, however, continues to move relative the pad 128 until the pad 128 is in the seated position. Movement of the saddle 120 relative to the pad 128 advances the rocker 124 toward the abutment surface 216, thereby causing the rocker 124 to rotate in a clockwise direction within the space 136 (FIGS. 5 and 6). The movement of the saddle 120 relative to the pad 128 also compresses the springs 320, 324 in the connection apparatus 300.

As the rocker 124 rotates, the point 164 of the rocker 124 advances toward the skirt 112 of the workpiece 104. Continued rotation of the rocker 124 advances the surface 176 toward the skirt 112 to bend the skirt 112 to the angle δ (FIG. 3) relative to the remainder 108 (and therefore the skirt 112 springs-back to the angle β (FIG. 2) during the upstroke of the press 10). Specifically, the surface 176 contacts the skirt 112 and forces the skirt 112 toward the surface 524 of the beak 512 until the surface 176 contacts the rocker seat 222 and the skirt 112 contacts the surface 524. Additionally, rotation of the rocker 124 from the position illustrated in FIG. 5 to the position illustrated in FIG. 6 causes a portion of the workpiece 104 to be located inside of the cavity 168.

After the skirt 112 has been bent to the angle δ, an upstroke of the press 10 is initiated to lift the apparatus 102 from the formed workpiece 104. As the ram 14 begins to move upward, the saddle 120 also moves upward; however, the pad 128 remains seated on the remainder 108. In particular, the springs 320, 324 urge the pad 128 away from the saddle 120 at the beginning of the upstroke. The relative motion between the saddle 120 and the pad 128 causes the rocker 124 to rotate in a counterclockwise direction (FIGS. 5 and 6). Specifically, as the springs 320, 324 urge the pad 128 away from the saddle 120, the spring 400 urges the rocker 124 in the counterclockwise direction. Thus, at the beginning of the upstroke the rocker 124 rotates as it is lifted from the workpiece 104.

The rotational motion of the rocker 124 at the beginning of the upstroke enables the apparatus 102 to be lifted from the workpiece 104 without the rocker 124 grabbing the skirt 112. The term "grabbing" as used herein refers to the bending, or otherwise deforming, of the workpiece 104 as a result of friction between the workpiece 104 and the rocker 124. The rocker 124 is configured to rotate at least until the point 164 does not contact any portion of the workpiece 104. Therefore, the system 100 bends the skirt 112 of a workpiece 104 to an angle β having a small magnitude small such as fifteen degrees) (15°) in a single downstroke of the press 10 without deforming, or otherwise affecting the shape of the workpiece 104 during the upstroke of the press 10.

An alternative embodiment of a pad is illustrated in FIG. 8. The pad 700 is movably coupled to the saddle 120 and extends into the cavity 168. The rocker 124 rotates in response to the pad 700 moving relative to the saddle 120. The pad 700 moves between an extended position (not shown) and a seated position, as shown in FIG. 8. In particular, the pad 700 is in the seated position at the completion of the downstroke of the press 10, and the pad 700 is in the extended position when the pad 700 is not in contact with a workpiece 104. The pad 700 may be formed from the same material as the saddle 120; namely, machinable through hardened steel.

As shown in FIG. 8, the pad 700 includes an abutment surface 704 and a workpiece seat 708. The abutment surface 704 is on the top side of the pad 700 and faces toward the saddle 120. The abutment surface 704 is a generally planar surface that is approximately parallel to the surface 212 of the saddle 120. The workpiece seat 220 and the abutment surface 216 are separated by the angle θ, as shown in FIG. 8. A plane defined by the abutment surface 704 intersects a plane defined by the workpiece seat 708. The angle θ between abutment surface 704 and the workpiece seat 708 determines, in part, the angle β. In particular, the angle β deceases in response to a decrease in the angle θ, and the angle β increases in response to an increase in the angle θ. At the completion of the downstroke, the abutment surface 704 contacts the surface 212. Relative movement between the saddle 120 and the pad 700 when the cavity surface 172 is positioned in contact with the abutment surface 704 causes rotation of the rocker 124 within the space 136.

The workpiece seat 708 is on the bottom side of the pad 700 and faces away from the saddle 120. As shown in FIG. 8, the workpiece seat 708 defines a workpiece contact surface 712, but does not define a rocker seat or a lip. The workpiece contact surface 712 is a generally flat portion that is approximately parallel to the bed 18. When the pad 700 is in the seated position, the workpiece contact surface 712 contacts the workpiece 104. Rotation of the rocker 124 within the space 136 causes the cavity surface 176 to advance toward the workpiece contact surface 712.

The pad 700 prevents the rocker 124 from grabbing the skirt 112 during the upstroke of the press 10. In particular, during the upstroke of the press 10 the pad 700 remains seated against the workpiece 104 as the saddle 120 is lifted from the workpiece 104, until the rocker 124 has rotated to a position in which the rocker 124 does not contact the workpiece 104.

Although the system 100 has been described in conjunction with a press that includes a ram configured to move in a vertical direction, the system 100 described herein is configured to operate with a press having a ram configured to move in any direction relative to a bed, inducing directions having a horizontal component. Additionally, the system 100 is configured to operate with a press that bends the workpiece 104 on an upstroke of the press.

The system 100 described herein has been illustrated and described in detail in the figures and foregoing description, the same should be considered as illustrative and not restrictive in character. It is understood that only the preferred embodiments have been presented and that all changes, modifications, and further applications that come within the spirit of the apparatus described herein are desired to be protected.

What is claimed is:

1. A forming assembly, comprising:

a rocker having an operating surface defining a cavity, said operating surface including a first cavity surface and a second cavity surface;

a saddle defining a space in which said rocker rotates; and a pad extending into said cavity and defining (i) an abutment surface which faces toward said saddle and defines a first plane, and (ii) a workpiece contact surface which faces away from said saddle and defines a second plane, wherein relative movement between said saddle and said pad when said first cavity surface is positioned in contact with said abutment surface causes rotation of said rocker within said space, wherein rotation of said rocker within said space causes said second cavity surface to advance toward said workpiece contact surface, and wherein said first plane intersects said second plane so as to define an angle θ.

2. The forming assembly of claim 1, wherein the angle θ is greater than ten degrees (10°) and less than thirty degrees (30°).

3. The forming assembly of claim 2, wherein the angle θ is approximately twenty degrees (20°).

4. The forming assembly of claim 1, wherein:

said pad includes a workpiece seat that defines said workpiece contact surface, and rotation of said rocker within said space further causes said rocker to move from a first relative position in which at least a portion of said workpiece seat is located outside of said cavity to a second relative position in which said portion of said workpiece seat is located inside of said cavity.

5. The forming assembly of claim 4, wherein:

when said pad is viewed in a cross-sectional view, said workpiece seat includes a flat portion and a curved portion that are contiguous with each other.

6. The forming assembly of claim 1, further comprising an anvil spaced apart from said workpiece contact surface so as to define a workpiece space therebetween, wherein:

rotation of said rocker within said space further causes said rocker to move from a first relative position in which at least a portion of said workpiece space is located outside of said cavity to a second relative position in which said portion of said workpiece space is located inside of said cavity.

7. The forming assembly of claim 1, further comprising a workpiece positioned against said workpiece contact surface, wherein:

rotation of said rocker within said space further causes said rocker to move from a first relative position in which said second cavity surface is spaced apart from said workpiece to a second relative position in which said second cavity surface contacts said workpiece.

8. The forming assembly of claim 1, further comprising a gib positioned in contact with said saddle, wherein:

said rocker is interposed between said saddle and said gib.

9. The forming assembly of claim 8, wherein said gib includes a retention portion that contacts said rocker during rotation of said rocker in relation to said saddle.

10. The forming assembly of claim 1, further comprising:

a first spring positioned and configured to urge said saddle and said pad away from each other; and a second spring positioned and configured to urge said rocker in a rotating path during movement of said saddle and said pad away from each other.

11. The forming assembly of claim 1, wherein when said rocker is viewed in a cross-sectional view:

said rocker defines an exterior surface extending from a first exterior surface location to a second exterior surface location, said operating surface further includes a transition surface extending from a first transition location to a second transition location, said first cavity surface extends from said first exterior surface location to said first transition location, and said second cavity surface extends from said second exterior surface location to said second transition location.

12. The forming assembly of claim 1, wherein:

said abutment portion is located on a top side of said pad, and said workpiece contact surface is located on a bottom side of said pad.

* * * * *